US005627630A

United States Patent [19]

Matsumae et al.

[11] Patent Number: 5,627,630

[45] Date of Patent: May 6, 1997

[54] DEVELOPING APPARATUS HAVING A TONER SUPPORTING ROLLER WITH AN INNER LAYER AND SURFACE LAYER

[75] Inventors: Iwao Matsumae, Tokyo; Yoshiaki Tanaka; Shigekazu Enoki, both of Kawasaki; Hiroshi Hosokawa, Yokohama, all of Japan

[73] Assignee: Ricoh Company, Ltd., Tokyo, Japan

[21] Appl. No.: 575,129

[22] Filed: Dec. 19, 1995

[30] Foreign Application Priority Data

Dec. 21, 1994 [JP] Japan ..... 6-318557

[51] Int. Cl.[6] ..... G03G 15/08

[52] U.S. Cl. ..... 399/267

[58] Field of Search ..... 355/251, 253, 355/259; 118/657, 658

[56] References Cited

U.S. PATENT DOCUMENTS

| | | | |
|---|---|---|---|
| 5,149,914 | 9/1992 | Koga et al. | 118/657 |
| 5,172,166 | 12/1992 | Funayama | 355/215 |
| 5,191,170 | 3/1993 | Yoshida et al. | 118/644 |

FOREIGN PATENT DOCUMENTS

| | | |
|---|---|---|
| 60-151668 | 8/1985 | Japan . |
| 3-259290 | 11/1991 | Japan . |
| 3-259278 | 11/1991 | Japan . |
| 4-181970 | 6/1992 | Japan . |
| 5-313474 | 11/1996 | Japan . |

*Primary Examiner*—Arthur T. Grimley
*Assistant Examiner*—Quana Grainger
*Attorney, Agent, or Firm*—Oblon, Spivak, McClelland, Maier & Neustadt, P.C.

[57] ABSTRACT

A developing apparatus includes a toner supporting member for attaching toner to an image supporting member on which an electrostatic latent image is formed so as to develop the electrostatic latent image with the toner supporting member and the image supporting member contacting each other. A toner restricting member forms a toner layer on the toner supporting member uniformly. Further, the toner supporting member has an elastic inner layer and a surface layer on which a magnetic portion is formed, and non-magnetic portions are formed on both end portions of said surface layer. Moreover, a length of the surface layer may be equal to or larger than a length of the inner layer in a longitudinal direction.

22 Claims, 3 Drawing Sheets

DEVELOPING APPARATUS HAVING A TONER SUPPORTING ROLLER WITH AN INNER LAYER AND SURFACE LAYER

BACKGROUND OF THE INVENTION

1. Field of the Invention

The present invention is directed to a developing apparatus used in an image forming apparatus in an electrophotographic method with one-component toner such as a copier, a facsimile, a printer, etc. More particularly, the present invention is directed to a developing apparatus which has a toner supporting member made of an elastic inner layer and a magnetic surface layer and in which non-magnetic portions are formed on both end portions of the magnetic surface layer.

2. Discussion of the Background

A photosensitive body of an image forming apparatus utilized in an electrophotographic method is categorized into a drum-type photosensitive body and a belt-type photosensitive body.

The drum-type photosensitive body is made of a relatively hard material. In a developing process, a toner supporting member for contacting the photosensitive body is made of an elastic material so as not to damage a photosensitive layer.

Japanese Patent Laid-Open Publications No. 3-259278, No. 3-259290, No. 4-181970, and No. 5-313474 disclose conventional toner supporting members in which a developing roller is used in an image forming apparatus. The developing roller has a magnetic surface layer with flexibility and an elastic inner layer.

In Japanese Patent Laid-Open Publications No. 3-259278 and No. 3-259290, the elastic inner layer has a rubber hardness based on JIS Japanese Industrial Standard Type A-K 6301 of 70° C. or less.

In Japanese Patent Laid-Open Publication No. 4-181970, the magnetic surface layer is made of rubber into which magnetable particles are dispersed. A pitch between magnetic poles in the developing roller is 100 μm or less.

In Japanese Patent Laid-Open Publication No. 5-313474, the developing roller has an inner surface made of foamed material and a surface layer with flexibility which is buried in the inner surface. Both end portions of the inner surface are not covered with the surface layer. The surface of the surface layer and the surface of the end portions in the inner layer are put on the same level. A thickness of the surface layer is 20~300 μm.

In these devices, the developing roller and a toner shielding member are sufficiently and tightly contacted with each other so that toner is prevented from overflowing from end portions of the developing roller.

However, these devices have a drawback that frictional endurances of the surface layer and the inner layer are different from each other. As a result, the inner layer is worn down by friction of the toner shielding member first. A gap between the inner layer and the toner shielding member then grows. The result is that shielding effect is deteriorated and wearing waste particles are scattered and are attached to a photosensitive drum and an optical lens so as to deteriorate an image.

The following further drawbacks also result in the conventional devices.

The wearing waste particles are inserted between the developing roller and a developing blade so as to prevent the proper forming of a toner layer on the developing roller.

Foreign particles such as plastic or metal particles accidentally attached on the inner layer are brought into contact with the photosensitive drum, and a part of the photosensitive drum is scratched off so as to deteriorate image formation.

As the developing roller and the toner shielding member are tightly contacted with each other, a revolutional loading torque of the developing roller is large so that a motor for the developing roller is imposed with an overload.

As the surface layer is buried in the inner surface, a concave step is formed on the surface of the inner layer so that a process of mechanical forming and dimension control are complicated.

SUMMARY OF THE INVENTION

Accordingly, the present invention provides for a novel developing apparatus for an image forming apparatus which can solve the aforementioned drawbacks, and, thus an object of the present invention is to provide for a developing apparatus in which toner is prevented from overflowing from end portions of a toner supporting member, and wearing waste particles are prevented from scattering into the image forming apparatus.

It is another object of the present invention to provide for a novel developing apparatus for an image forming apparatus in which revolutional loading torque of a toner supporting member can be decreased so that a motor for the toner supporting member is prevented from being imposed with an overload.

In order to achieve the above-mentioned objects, the present invention provides for a developing apparatus which includes a toner supporting member for attaching toner to an image supporting member on which an electrostatic latent image is formed so as to develop the electrostatic latent image with the toner supporting member and the image supporting member contacting each other. A toner restricting member forms a toner layer on the toner supporting member uniformly. Further, the toner supporting member has an elastic inner layer and a surface layer on which a magnetic portion is formed, and non-magnetic portions are formed on both end portions of the surface layer. Moreover, a length of the surface layer may be equal to or larger than that of the inner layer in a longitudinal direction.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
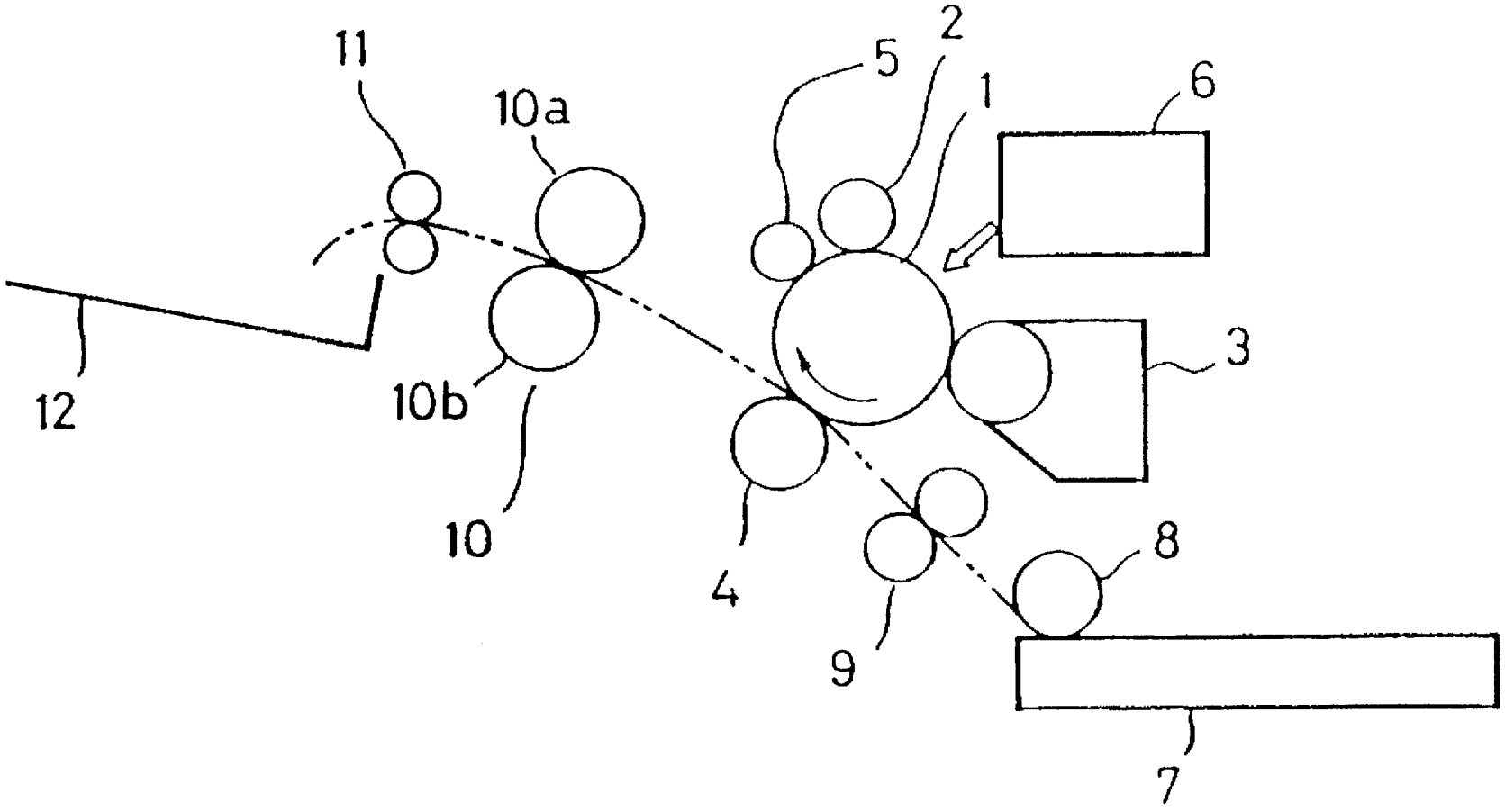
FIG. 1 is a diagram showing an overall structure of an image forming apparatus in accordance with the present invention.

Preferred embodiments of a developing apparatus for an image forming apparatus in accordance with the present invention will now be explained with reference to the accompanying drawings, wherein like reference numerals are utilized to designate identical or corresponding elements throughout the several views.

FIG. 1 is a diagram showing an overall structure of the image forming apparatus in accordance with the present invention. As illustrated in FIG. 1, the image forming apparatus is provided with an image supporting member 1, a charging apparatus 2, a developing apparatus 3, a transferring apparatus 4, a cleaning apparatus 5, an optical writing apparatus 6, a paper feeding cassette 7, a paper feeding roller 8, a registering apparatus 9, a fixing apparatus 10, a pair of paper discharging rollers 11, and a paper discharging tray 12.

The charging apparatus 2, the developing apparatus 3, the transferring apparatus 4, and the cleaning apparatus 5 are disposed around a drum type photosensitive body 1 which is the image supporting member. A portion of the photosensitive body 1 exposed by the optical writing apparatus 6 is disposed between the charging apparatus 2 and the developing apparatus 3. The paper feeding cassette 7 is disposed at the lower side of the photosensitive body 1.

The charging apparatus 2 charges a surface of the photosensitive body 1 uniformly. The developing apparatus 3 attaches toner to an electrostatic latent image formed on the photosensitive body 1 so as to visualize the electrostatic latent image. The transferring apparatus 4 transfers the toner image formed on the photosensitive body 1 to a recording paper. The cleaning apparatus 5 collects residual toner from the photosensitive body 1 after the toner image on the photosensitive body 1 is transferred to the recording paper. The optical writing apparatus 6 forms the electrostatic latent image on the photosensitive body 1 with exposure. The paper feeding cassette 7 stocks the recording paper. The paper feeding roller 8 feeds the recording paper in the paper feeding cassette 7 to the image forming apparatus. The registering apparatus 9 transfers the recording paper to the transferring apparatus 4 with a predetermined timing. The fixing apparatus 10 fixes the toner image on the recording paper. The paper discharging rollers 11 discharge the recording paper from the image forming apparatus. The paper discharging tray 12 stocks the recording paper on which an image is formed.

Figure 2:
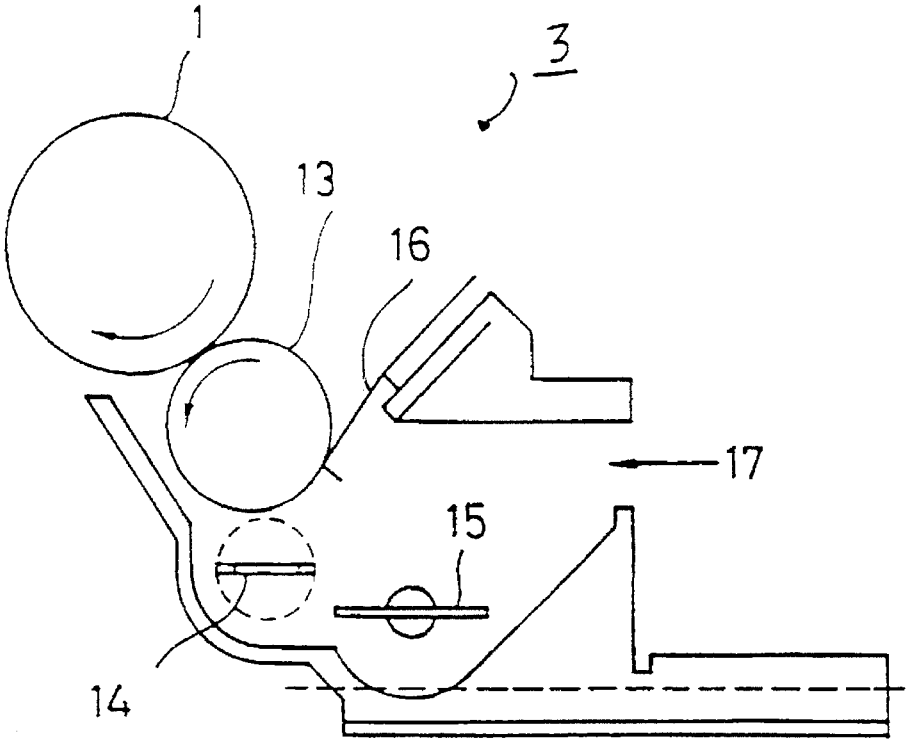
FIG. 2 is a section showing a developing apparatus in accordance with the present invention.

FIG. 2 is a section showing the developing apparatus 3 in accordance with the present invention.

As illustrated in FIG. 2, the developing apparatus 3 is provided with a developing roller 13 which is a toner supporting member, a supplying plate 14 for supplying toner to the developing roller 13, an agitator 15 for agitating toner, a developing blade 16 which is a toner restricting member for contacting with the developing roller 13, and an opening 17 for supplying fresh toner. The developing roller 13, the supplying plate 14, and the agitator 15 are rotatably supported on side plates (not shown) on both sides.

Toner is supplied through the opening 17 from a toner cartridge, the toner is delivered with the agitator 15 and the supplying plate 14 to the left side of FIG. 2, and the toner is then attached on the developing roller 13. When the developing roller 13 is rotated in the arrow direction, a thin toner layer is formed on the developing roller 13 by pressing with the developing blade 16.

A nip portion is formed between the developing roller 13 and the photosensitive body 1. The electrostatic latent image on the photosensitive body 1 is developed with toner on the developing roller 13.

Figure 3:
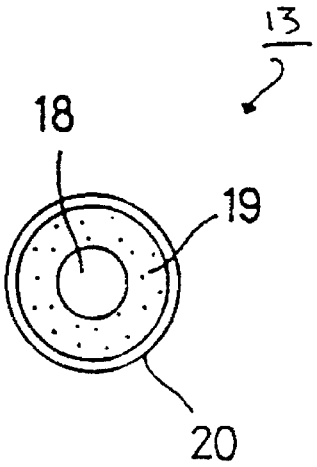
FIG. 3 is a section showing a developing roller.
Figure 4:
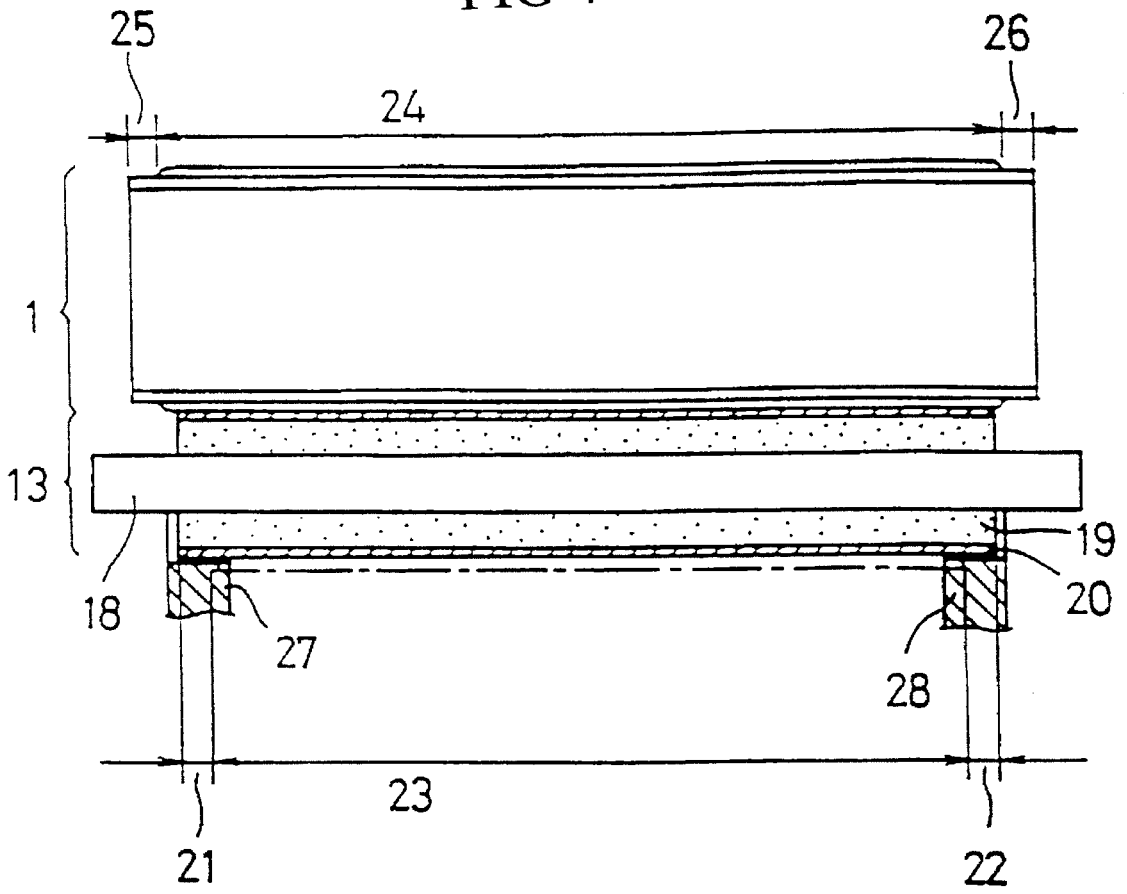
FIG. 4 is a section showing the developing roller and a photosensitive body.

FIG. 3 is a section showing the developing roller 13 and FIG. 4 is a section showing the developing roller 13 and the photosensitive body 1. The developing roller 13 is provided with a metallic core 18, an inner layer 19, and a surface layer 20. A magnetic portion 23 is formed on the surface layer 20, and non-magnetic portions 21, 22 are formed on both end portions of the surface layer 20, see FIGS. 4 and 5. Magnetic poles are located in the magnetic portion 23, and no magnetic pole is located in the non-magnetic portions 21, 22.

A length of the surface layer 20 and that of the inner layer 19 in the longitudinal direction may be the same. Toner shielding members 27, 28 are disposed on both end portions of the developing roller 13.

An area covered with the toner shielding members 27, 28 includes the non-magnetic portions 21, 22. A valid sensitivity area 24 is formed on the photosensitive body 1, and low-sensitivity areas 25, 26 are formed on both end portions of the photosensitive body 1.

A length of the valid sensitivity area 24 and that of the developing roller 13 in the longitudinal direction may be the same, or the length of the valid sensitivity area 24 may be larger than that of the developing roller 13 in the longitudinal direction.

Figure 5:
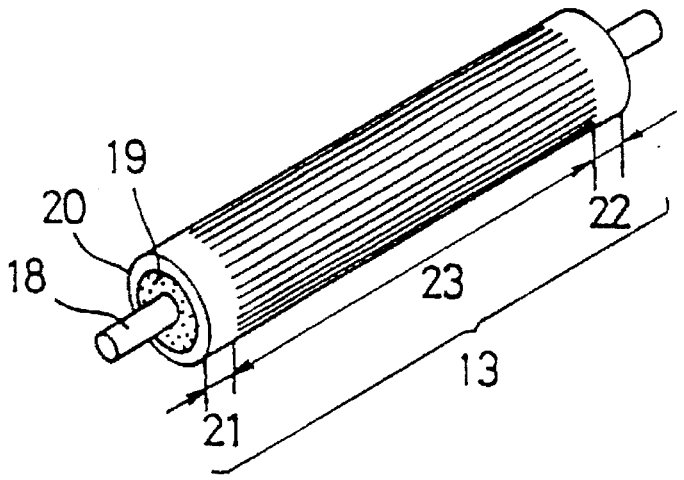
FIG. 5 is a perspective view showing the developing roller of FIG. 3.

FIG. 5 is a perspective view showing the developing roller 13 of FIG. 3. As illustrated in FIG. 5, magnetic poles are located in the magnetic portion 23 by using a magnetizing apparatus with a fine pitch (200~1000 μm). In this embodiment as an example, a pitch for the magnetic poles is 750 μm and magnetic flux density is 8 mT. As an example, the inner layer 19 may be made of polybutadiene rubber, which has a hardness based on JIS Japanese Industrial Standard A-K 6301 of 30°. The surface layer 20 may be made of EPDM (Terpolymer of ethylene, propylene and a diene with a residual unsaturated portion of the diene in the side chain) rubber, which has a hardness based on JIS A-K 6301 of 80°~90°. The length of the surface layer 20 may also be larger than that of the inner layer 19 in the longitudinal direction.

Obviously, numerous additional modifications and variations of the present invention are possible in light of the above teachings. It is therefore to be understood that within the scope of the appended claims, the present invention may be practiced otherwise than as specifically described herein.

What is claimed as new and desired to be secured by letters patent of the United States is:

1. A toner supporting roller for a developing roller, comprising:

an inner layer;

a surface layer covering the inner layer, wherein the surface layer includes a central magnetic portion and non-magnetic portions formed at both end portions of the central magnetic portion, wherein the inner layer comprises polybutadiene rubber and has a JIS A-K 6061 hardness of 30°.

2. The toner supporting roller according to claim 1, wherein the surface layer comprises EPDM and has a JIS hardness A-K 6301 between 80°–90°.

3. The toner supporting roller according to claim 2, wherein a length of said surface layer is at least equal to a length of said inner layer in a longitudinal direction.

4. The toner supporting roller according to claim 1, wherein a length of said surface layer is at least equal to a length of said inner layer in a longitudinal direction.

5. A toner supporting roller for a developing roller, comprising:

an inner layer;

a surface layer covering the inner layer, wherein the surface layer includes a central magnetic portion and non-magnetic portions formed at both end portions of the central magnetic portion, wherein the surface layer comprises EPDM and has a JIS A-K 6301 hardness between 80°–90°.

6. The toner supporting roller according to claim 5, wherein a length of said surface layer is at least equal to a length of said inner layer in a longitudinal direction.

7. A developing apparatus comprising:

a toner supporting member for attaching toner to an image supporting member on which an electrostatic latent image is formed so as to develop the electrostatic latent image with said toner supporting member and said image supporting member contacting each other;

a toner restricting member for forming a toner layer on said toner supporting member uniformly;

wherein said toner supporting member includes an elastic inner layer and surface layer on which a magnetic portion is formed, and non-magnetic portions are formed on both end portions of said surface layer, wherein the inner layer comprises polybutadiene rubber and has a JIS A-K 6061 hardness of 30°.

8. The developing apparatus according to claim 7, wherein a length of said magnetic portion on said surface layer is smaller than said length of said surface layer in the longitudinal direction.

9. The developing apparatus of claim 7, wherein said length of said surface layer is equal to or smaller than a length of a valid sensitivity area on said image supporting member in the longitudinal direction.

10. The developing apparatus according to claim 7, further comprising toner shielding members disposed to slidably contact with said both end portions of said toner supporting member.

11. The developing apparatus according to claim 7, wherein a length of said surface layer is at least equal to a length of said inner layer in a longitudinal direction.

12. The developing apparatus according to claim 7, wherein the surface layer comprises EPDM and has a JIS A-K 6301 hardness between 80°–90°.

13. A developing apparatus comprising:

a toner supporting member for attaching toner to an image supporting member on which an electrostatic latent image is formed so as to develop the electrostatic latent image with said toner supporting member and said image supporting member contacting each other;

a toner restricting member for forming a toner layer on said toner supporting member uniformly;

wherein said toner supporting member includes an elastic inner layer and surface layer on which a magnetic portion is formed, and non-magnetic portions are formed on both end portions of said surface layer, wherein the surface layer comprises EPDM and has a JIS A-K 6301 hardness between 80°–90°.

14. The developing apparatus according to claim 13, wherein a length of said magnetic portion on said surface layer is smaller than said length of said surface layer in the longitudinal direction.

15. The developing apparatus according to claim 13, wherein said length of said surface layer is equal to or smaller than a length of a valid sensitivity area on said image supporting member in the longitudinal direction.

16. The developing apparatus according to claim 13, further comprising toner shielding members disposed to slidably contact with said both end portions of said toner supporting member.

17. The developing apparatus according to claim 13, wherein a length of said surface layer is at least equal to a length of said inner layer in a longitudinal direction.

18. An image forming apparatus comprising:

an image supporting member;

a charging apparatus;

a transferring apparatus;

a cleaning apparatus;

an optical writing apparatus;

a paper feeding and discharging member;

a registering apparatus;

a fixing apparatus;

a toner supporting member for attaching toner to the image supporting member on which an electrostatic latent image is formed so as to develop the electrostatic latent image with said toner supporting member and said image supporting member contacting each other;

a toner restricting member for forming a toner layer on said toner supporting member uniformly; and wherein said toner supporting member includes an elastic inner layer and a surface layer on which a magnetic portion is formed, and non-magnetic portions are formed on both end portions of said surface layer, wherein the inner layer comprises polybutadiene rubber and has a JIS A-K 6061 hardness of 30°.

19. The image forming apparatus according to claim 18, wherein a length of said surface layer is at least equal to a length of said inner layer in a longitudinal direction.

20. The image forming apparatus according to claim 18, wherein the surface layer comprises EPDM and has a JIS A-K hardness between 80°–90°.

21. An image forming apparatus comprising:

an image supporting member;

a charging apparatus;

a transferring apparatus;

a cleaning apparatus;

an optical writing apparatus;

a paper feeding and discharging member;

a registering apparatus;

a fixing apparatus;

a toner supporting member for attaching toner to the image supporting member on which an electrostatic latent image is formed so as to develop the electrostatic latent image with said toner supporting member and said image supporting member contacting each other;

a toner restricting member for forming a toner layer on said toner supporting member uniformly; and wherein said toner supporting member includes an elastic inner layer and a surface layer on which a magnetic portion is formed, and non-magnetic portions are formed on both end portions of said surface layer, wherein the surface layer comprises EPDM and has a JIS A-K 6301 hardness between 80°–90°.

22. The image forming apparatus according to claim 21, wherein a length of said surface layer is at least equal to a length of said inner layer in a longitudinal direction.

* * * * *